US011912483B1

(12) United States Patent
Tsao

(10) Patent No.: US 11,912,483 B1
(45) Date of Patent: Feb. 27, 2024

(54) MULTI-FUNCTIONAL CATERING CONTAINER

(71) Applicant: Chung-Piao Tsao, Taipei (TW)

(72) Inventor: Chung-Piao Tsao, Taipei (TW)

( * ) Notice: Subject to any disclaimer, the term of this patent is extended or adjusted under 35 U.S.C. 154(b) by 0 days.

(21) Appl. No.: 17/822,330

(22) Filed: Aug. 25, 2022

(51) Int. Cl.
*B65D 71/62* (2006.01)

(52) U.S. Cl.
CPC .... *B65D 71/004* (2013.01); *B65D 2571/0029* (2013.01); *B65D 2571/00487* (2013.01); *B65D 2571/0066* (2013.01); *B65D 2571/00932* (2013.01)

(58) Field of Classification Search
CPC ..... B65D 71/004; B65D 2571/0029; B65D 2571/00487; B65D 2571/0066; B65D 2571/00932; B65D 71/62
USPC ..... 206/541, 557–565; 383/7, 38, 121, 125
See application file for complete search history.

(56) References Cited

U.S. PATENT DOCUMENTS 1,093,110 A * 4/1914 Christopher ..... B65D 1/36 206/541
2,326,417 A * 8/1943 Ullrich ..... B65D 5/0263 229/117
2,640,589 A * 6/1953 Foster ..... B65D 71/72 206/565
2,944,694 A * 7/1960 Kinsey ..... A47G 23/06 220/23.88
3,512,700 A * 5/1970 Evans ..... B65D 31/00 383/120
5,505,307 A * 4/1996 Shink ..... B60N 3/103 206/541
6,394,265 B1 * 5/2002 Tsao ..... B65D 77/22 206/217
7,500,557 B2 * 3/2009 Picciolo ..... B65D 71/004 206/196
7,850,004 B2 * 12/2010 Picciolo ..... B65D 71/004 206/196
8,910,823 B2 * 12/2014 Mesman ..... B65D 33/02 220/529
2015/0125096 A1 * 5/2015 Mulholland ..... B65D 31/02 383/38

FOREIGN PATENT DOCUMENTS

JP 201558956 A * 3/2015 ..... B65D 67/02

* cited by examiner

*Primary Examiner* — Bryon P Gehman
(74) *Attorney, Agent, or Firm* — Leong C. Lei

(57) ABSTRACT

A multi-functional catering container is provided, including a loading body, a first storage unit, and a second storage unit. The loading body is a plate structure, a placement hole is provided on the loading body, and the placement hole is used to load a container. The first storage unit is disposed to extend from one side of the loading body, a bottom of the first storage unit is provided with a first bottom plane, a top of the first storage unit is provided with a first opening, and the first storage unit is used to accommodate food. The second storage unit is disposed to extend from another side of the loading body and opposite to the first storage unit, a bottom of the second storage unit is provided with a second bottom plane, and a top of the second storage unit is provided with a second opening.

9 Claims, 8 Drawing Sheets

MULTI-FUNCTIONAL CATERING CONTAINER

BACKGROUND OF THE INVENTION

1. Field of the Invention

The present disclosure relates to a technical field of a catering container, particularly to a multi-functional catering container that can accommodate a drink cup and food.

2. Description of the Related Art

With the increasing awareness of environmental protection, utilizing paper boxes to contain food or things has been widely adopted and valued by people nowadays. Particularly, recycled paper can be used to make cartons, thus achieving reusing paper resources and avoiding the problem of waste contamination caused by styrofoam, plastics, or other non-recyclable materials.

The structure of a conventional carton is used for only one purpose, that is, containing food or things; however, with the prevalence of various beverages, most consumers have to hold a beverage container in their hands, making it very inconvenient for them to hold a food carton in one hand and a beverage container in the other. Therefore, to make it easier for consumers to carry food cartons or beverage containers, merchants use plastic bags to contain food cartons or beverage containers; in this way, under the condition that plastic bags are used in large quantities, the possibility of environmental pollution also relatively increased.

In addition, although the armrests of seats at movie theaters are equipped with structures for placing drink cups, there are no structures for placing food such as popcorn and fried chicken; consumers usually hold popcorn and fried chicken in their hands, hold them on their chests, or place them on their laps continually. This situation often causes inconvenience to these people.

Accordingly, with years of experience in the manufacture, development, and design of related products, the inventor of the present disclosure has designed a multi-functional catering container aiming at the above-mentioned objectives, in an effort to tackle deficiencies in the prior art and further enhance the implementation and application in industries.

SUMMARY OF THE INVENTION

In view of the aforementioned conventional problems, the purpose of the present disclosure is to provide a multi-functional catering container in an attempt to solve the conventional problems that need to be addressed.

Based on the aforementioned purpose, the present disclosure provides a multi-functional catering container, including a loading body, a first storage unit, and a second storage unit. The loading body is a plate structure, a placement hole is provided on the loading body, and the placement hole is used to load a container. The first storage unit is disposed to extend from one side of the loading body, a bottom of the first storage unit is provided with a first bottom plane, a top of the first storage unit is provided with a first opening, and the first storage unit is used to accommodate food. The second storage unit is disposed to extend from another side of the loading body and opposite to the first storage unit, a bottom of the second storage unit is provided with a second bottom plane, a top of the second storage unit is provided with a second opening, and the second storage unit is used to accommodate another food.

Preferably, two sides of the second storage unit and the second bottom plane are respectively provided with a folding line.

Preferably, the first bottom plane is formed by a plurality of bottom plate sections that are interlaced and snapped.

Preferably, the loading body is disposed with an extension plate extending from an edge of the placement hole.

Preferably, the extension plate is provided with a gap.

Preferably, the extension plate is provided with a plurality of bending lines at intervals along an extending direction of the extension plate, two sides of the extension plate are oppositely provided with a plurality of snap-cut lines, the plurality of bending lines are configured to be folded for the extension plate corresponding to the gap, and the plurality of snap-cut lines on the corresponding side are snapped with each other.

Preferably, a direction in which the loading body is disposed with the extension plate extending from an edge of the placement hole is perpendicular to a direction in which the first storage unit and the second storage unit are oppositely disposed.

Preferably, the loading body, the first storage unit, and the second storage unit are formed by integrally bending and gluing a plate body.

Preferably, the plate body includes a loading body section, a first unit section, and a second unit section. The loading body section has the placement hole, and the first unit section and the second unit section are disposed on two opposite sides of the loading body section. The first unit section includes a sidewall section and a plurality of bottom plate sections extending from the sidewall section; after the sidewall section is bent and encircled, one end is fixed to another end thereof, and the plurality of bottom plate sections are interlaced to form the first bottom plane, further forming the first storage unit. The second unit section includes a main area section and two flank sections; the main area section includes a first main area, a bottom plane area, and a second main area connected in sequence; the two flank sections oppositely extend from the first main area; after the main area section is bent and encircled, the bottom plane area forms the second bottom plane, and one end of each of the flank sections is fixed to the second main area, further forming the second storage unit.

Preferably, an edge of the placement hole is extendedly disposed with an extension plate, and the extension plate is provided with a gap.

Preferably, the bottom plane area and the two flank sections are respectively provided with a folding line.

The technical features of the present disclosure are to be described in detail below with specific embodiments and accompanying drawings to make a person with ordinary skill in the art effortlessly understand the purpose, technical features, and advantages of the present disclosure.

BRIEF DESCRIPTION OF THE DRAWINGS

The drawings required for the description of the embodiments of the present disclosure are to be briefly described below to illustrate more clearly the technical solutions of the embodiments of the present disclosure. It is obvious that the accompanying drawings described below are only some embodiments of the present disclosure. For a person with ordinary skill in the art, additional drawings can be obtained according to these drawings.

DESCRIPTION OF THE PREFERRED EMBODIMENTS

To facilitate the understanding of the technical features, contents, advantages, and achievable effects of the present disclosure, the embodiments together with the accompanying drawings are described in detail as follows. However, the drawings are used only for the purpose of indicating and supporting the specification, which is not necessarily the real proportion and precise configuration after the implementation of the present disclosure. Therefore, the relations of the proportion and configuration of the accompanying drawings should not be interpreted to limit the actual scope of implementation of the present disclosure.

Figure 1:
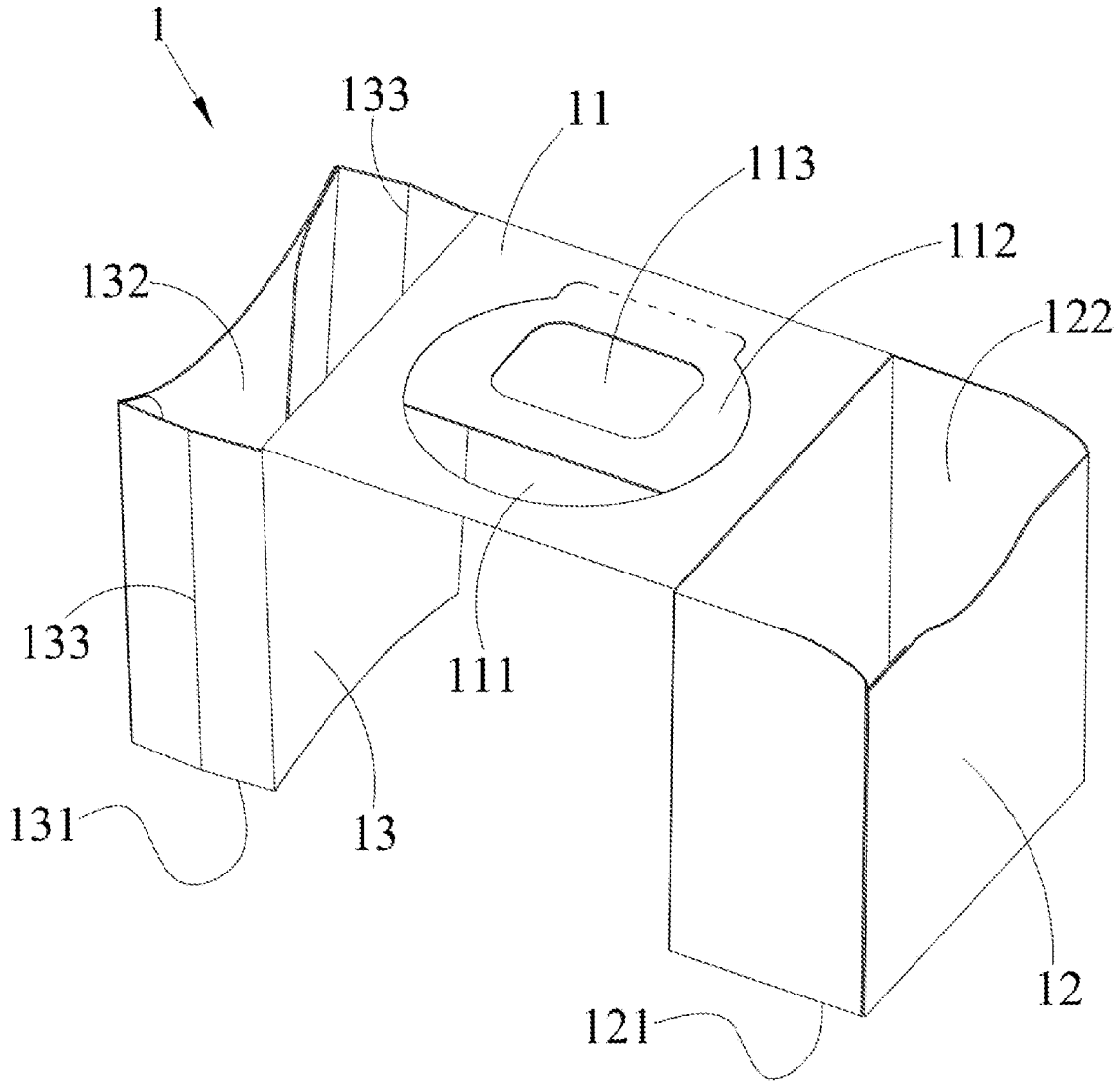
FIG. 1 is a first schematic diagram of the first embodiment according to the multi-functional catering container of the present disclosure.
Figure 2:
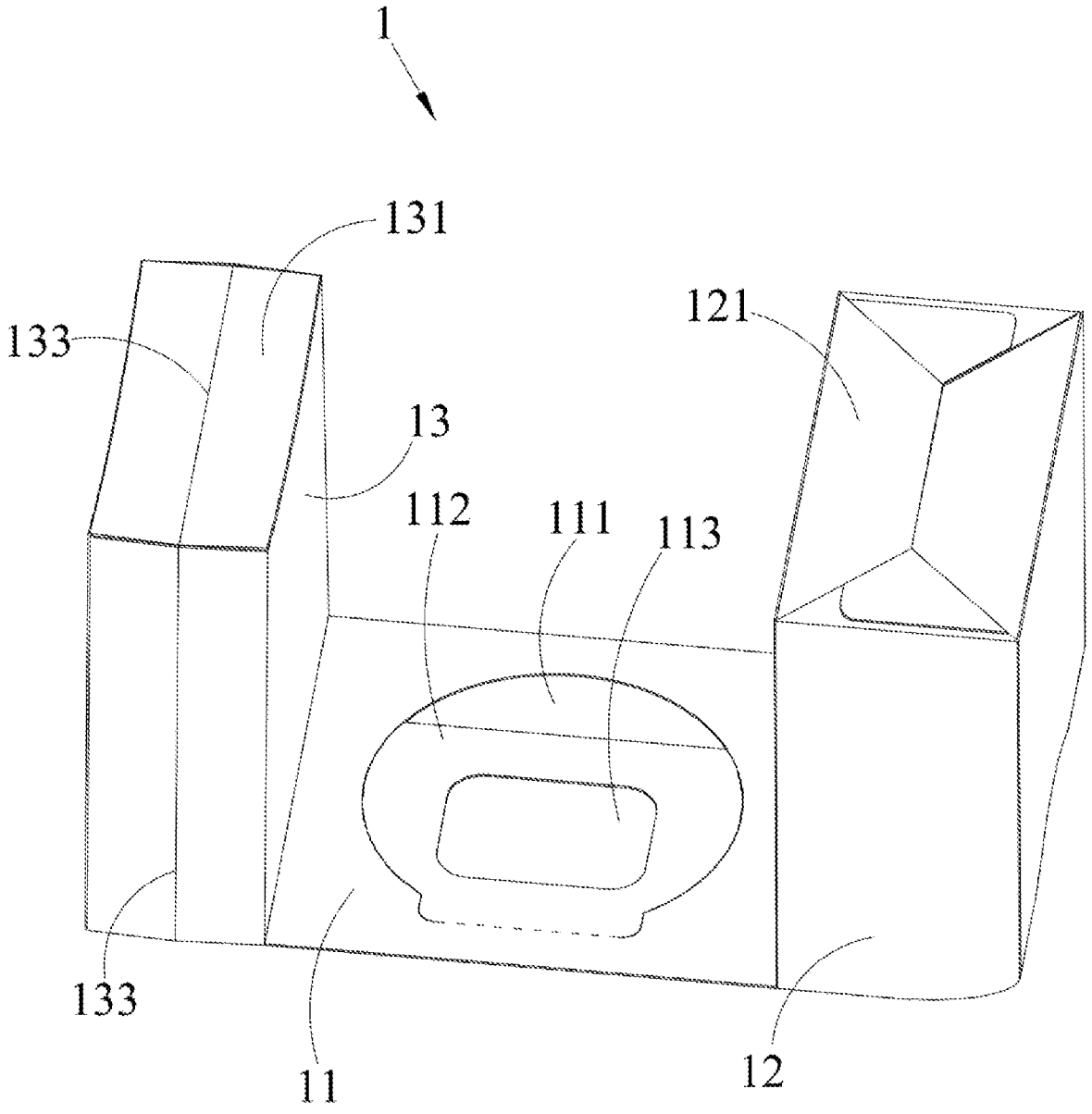
FIG. 2 is a second schematic diagram of the first embodiment according to the multi-functional catering container of the present disclosure.
Figure 3:
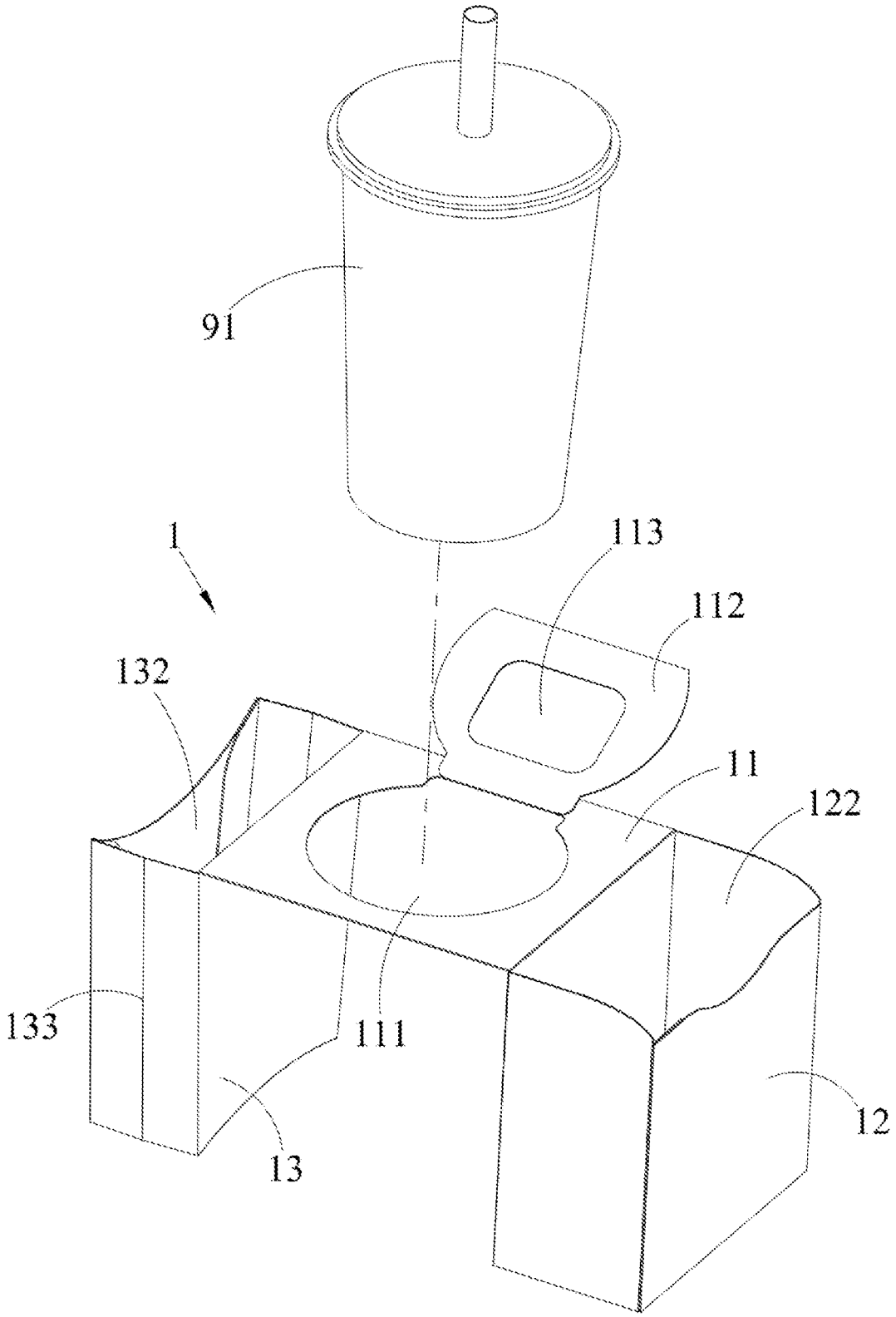
FIG. 3 is a first application diagram of the first embodiment according to the multi-functional catering container of the present disclosure.
Figure 4:
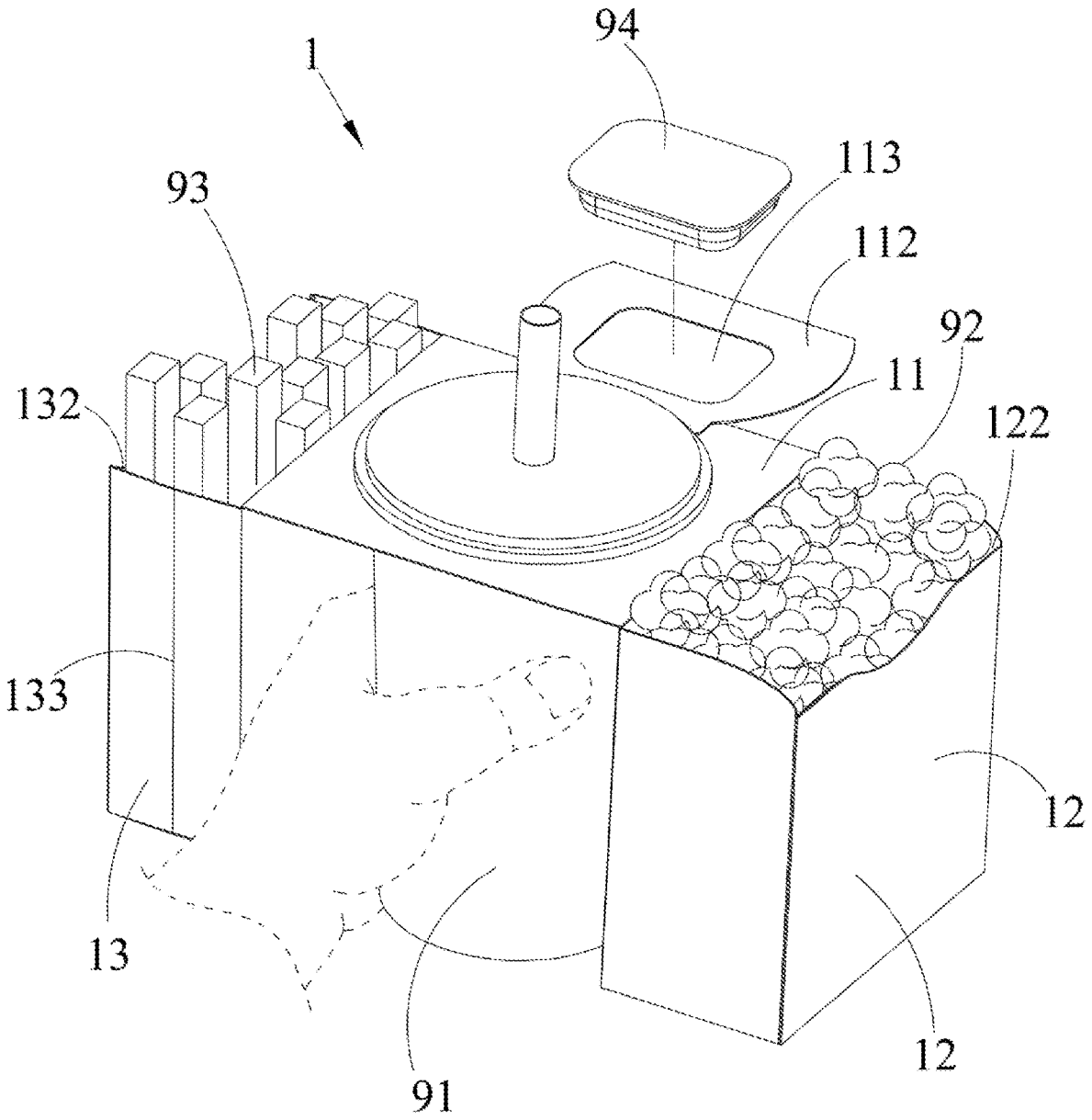
FIG. 4 is a second application diagram of the first embodiment according to the multi-functional catering container of the present disclosure.

Please refer to FIG. 1 to FIG. 4. FIG. 1 and FIG. 2 are the first and second schematic diagrams of the first embodiment according to the multi-functional catering container of the present disclosure, respectively. FIG. 3 and FIG. 4 are the first and second application diagrams of the first embodiment according to the multi-functional catering container of the present disclosure, respectively. As shown in the figures, the present disclosure provides a multi-functional catering container 1, including a loading body 11, a first storage unit 12, and a second storage unit 13.

Particularly, the loading body 11 may be made of paper material, which is a plate structure, and a placement hole 111 is provided on the loading body 11. Wherein, the placement hole 111 is used to hold a container 91. The container 91 is mainly used to contain fluid or liquid-state beverages, such as tea, carbonated drinks, coffee, milkshakes, and the like. The placement hole 111 may be used to place the container 91 from top to bottom (as shown in FIG. 3), and the opening of the container 91 or a part of the cover body is snapped into the placement hole 111, so that the container 91 may be stably placed in the placement hole 111.

Wherein, the first storage unit 12 may be in the shape of a rectangular box made of paper material, which extends from one side of the loading body 11. The bottom of the first storage unit 12 is provided with a first bottom plane 121, and the top of the first storage unit 12 is provided with a first opening 122. The first storage unit 12 is used to accommodate food 92, and the first opening 122 may allow food 92 to be put into the accommodation space of the first storage unit 12 (as shown in FIG. 4). Wherein, the food 92 may be, for example, popcorn, fried chicken, and French fries.

Particularly, the second storage unit 13 may be in the shape of a French fries box made of paper material, which extends from another side of the loading body 11 and is opposite to the first storage unit 12. The bottom of the second storage unit 13 is provided with a second bottom plane 131, and the top of the second storage unit 13 is provided with a second opening 132. The second storage unit 13 is used to accommodate another food 93, and the second opening 132 may allow the other food 93 to be put into the accommodation space of the second storage unit 13 (as shown in FIG. 4). Wherein, the other food 93 may be, for example, popcorn, fried chicken, French fries, and the like.

That is to say, the food contained in the first storage unit 12 and the second storage unit 13 may or may not be the same; for example, the first storage unit 12 may contain popcorn and the second storage unit 13 may contain French fries, or both the first storage unit 12 and the second storage unit 13 contain French fries.

It is worth mentioning that the loading body 11 is disposed with an extension plate 112 extending from an edge of the placement hole 111. Wherein, a direction in which the loading body 11 is disposed with the extension plate 112 extending from an edge of the placement hole 111 is perpendicular to a direction in which the first storage unit 12 and the second storage unit 13 are oppositely disposed. The extension plate 112 may be bent upward by the user (as shown in FIG. 4).

Preferably, the extension plate 112 is provided with a gap 113, and the shape of the extension plate 112 may be an approximately circular shape with a cut flat section, and the cut flat section is at a position opposite to where the extension plate 112 is in connection with the loading body 11. Preferably, the extension plate 112 may be bent upward by the user, so that the user may place the box-shaped sauce box 94 such as sweet and sour sauce, mustard sauce, and the like, in the gap 113.

In addition, the first bottom plane 121 is formed by a plurality of bottom plate sections 222 that are interlaced and snapped. Therefore, if the user interlaces and snaps the plurality of bottom plate sections 222, the first storage unit 12 may be formed into a box shape; if the user disassembles the plurality of bottom plate sections 222 and folds the bending lines, the first storage unit 12 may be made into a flat shape. On the other hand, two sides of the second storage unit 13 and the second bottom plane 131 are respectively provided with a folding line 133. Similarly, the user may make the second storage unit 13 a flat shape by folding the folding lines 133. That is to say, the first storage unit 12 and the second storage unit 13 may be made into a flat shape, thus reducing the space occupied in storage or during shipping.

Figure 5:
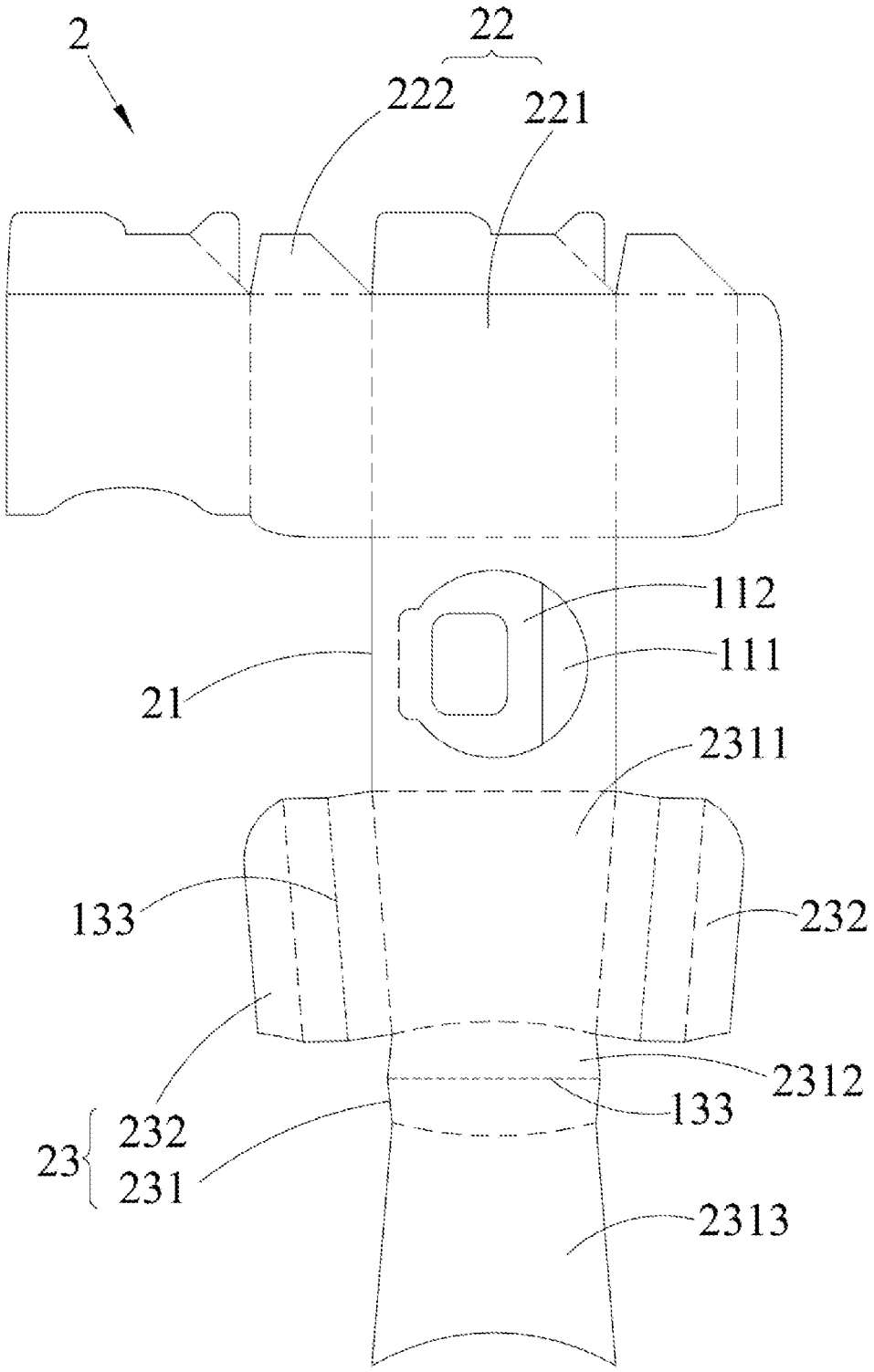
FIG. 5 is an expanded schematic diagram of the first embodiment according to the multi-functional catering container of the present disclosure.

Please refer to FIG. 5 as well. FIG. 5 is an expanded schematic diagram of the multi-functional catering container of the present disclosure.

As shown in the figure, the loading body 11, the first storage unit 12, and the second storage unit 13 of the multi-functional catering container 1 of the present disclosure are formed by integrally bending and gluing a plate body 2.

Further, the plate body 2 includes a loading body section 21, a first unit section 22, and a second unit section 23. Wherein, the loading body section 21 has the placement hole 111, and the first unit section 22 and the second unit section 23 are disposed on two opposite sides of the loading body section 21. Wherein, the first unit section 22 includes a sidewall section 221 and a plurality of bottom plate sections 222 extending from the sidewall section 221. It is worth mentioning that the sidewall section 221 is provided with a plurality of bending lines for being bent into a shape similar to a square by the user. Wherein, after the sidewall section 221 is bent and encircled, one end is fixed to another end thereof, and the plurality of bottom plate sections 222 are interlaced to form the first bottom plane 121, further forming the first storage unit 12. Wherein, the second unit section 23 includes a main area section 231 and two flank sections 232. The main area section 231 may be provided with a plurality of bending lines, thus including a first main area 2311, a bottom plane area 2312, and a second main area 2313 which are connected in sequence. The bending lines allow the user to bend the main area section 231 into the front face, back face, and bottom face of the second storage unit 13. The two flank sections 232 oppositely extend from the first main area 2311, and the flank sections 232 may be provided with a plurality of bending lines, so that after the main area section 231 is bent and encircled, the bottom plane area 2312 forms the second bottom plane 131, and one end of each of the flank sections 232 is fixed to the second main area 2313, further forming the second storage unit 13.

It is worth mentioning that the bottom plane area 2312 and the two flank sections 232 are respectively provided with a folding line 133. The user may make the second storage unit 13 a flat shape by folding the folding lines 133. As for the first storage unit 12, the user disassembles the plurality of bottom plate sections 222 and folds the bending lines, so that the first storage unit 12 may be made into a flat shape.

Figure 6:
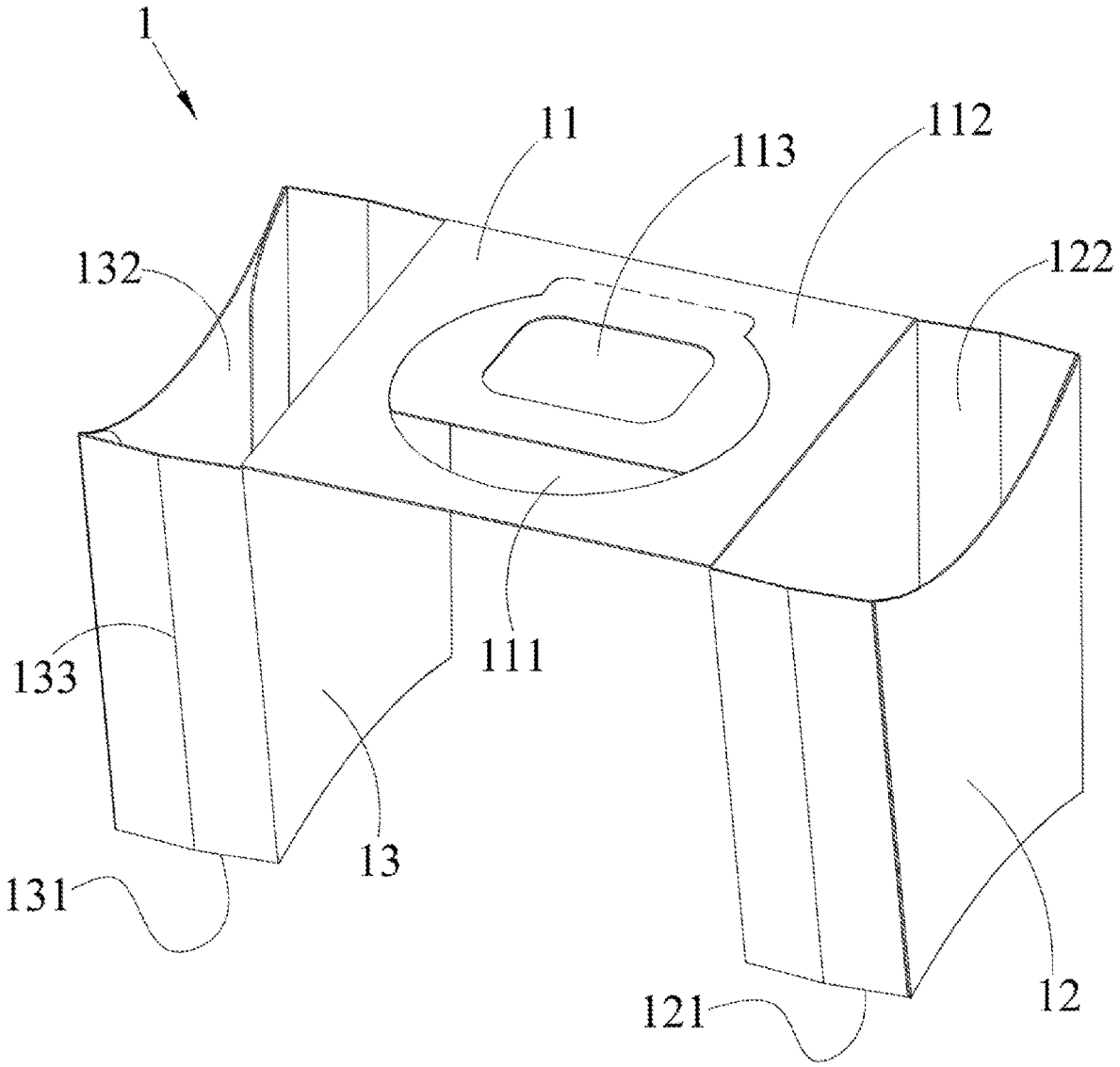
FIG. 6 is a schematic diagram of the second embodiment according to the multi-functional catering container of the present disclosure.

Please refer to FIG. 6, which is a schematic diagram of the second embodiment according to the multi-functional catering container of the present disclosure.

As shown in the figure, the main difference between the present embodiment and the previous embodiments is that the first storage unit 12 and the second storage unit 13 may be storage boxes having the same shape; in the present embodiment, the first storage unit 12 and the second storage unit 13 may also be in the shape of a French fries box as exemplary examples.

Figure 7:
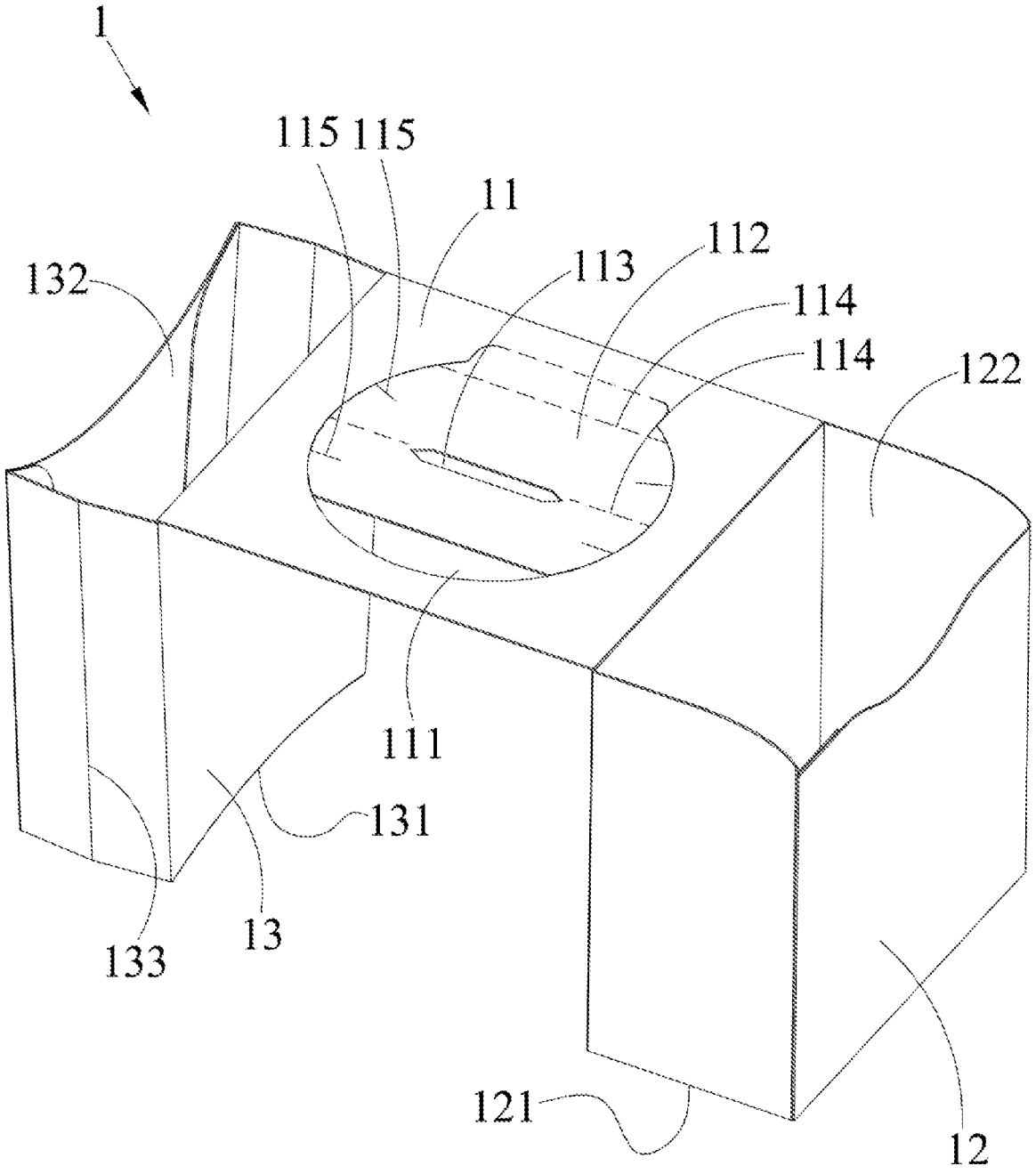
FIG. 7 is a schematic diagram of the third embodiment according to the multi-functional catering container of the present disclosure.
Figure 8:
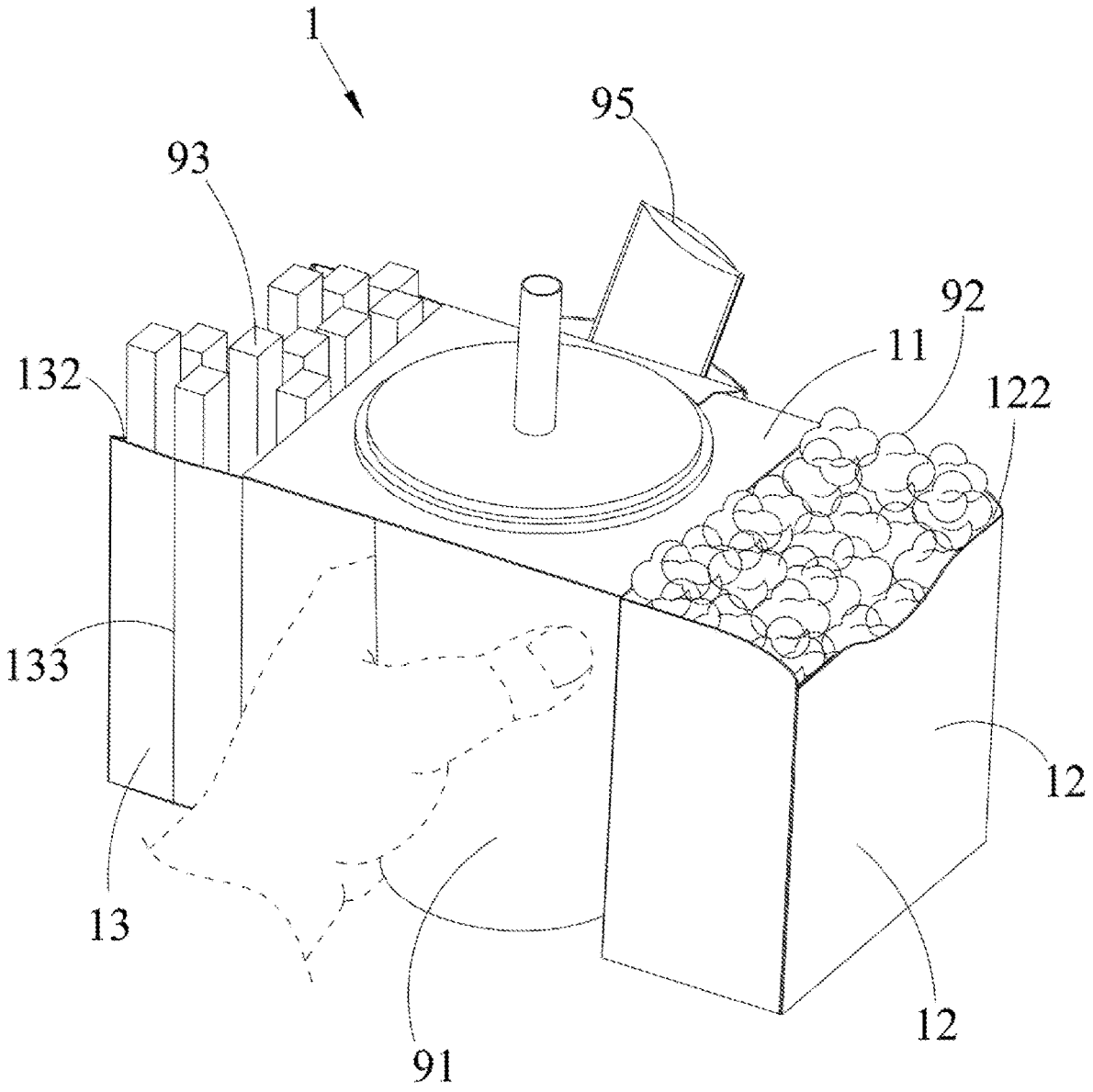
FIG. 8 is an application diagram of the third embodiment according to the multi-functional catering container of the present disclosure.

Please refer to FIG. 7 and FIG. 8, which respectively are a schematic diagram and an application diagram of the third embodiment according to the multi-functional catering container of the present disclosure.

As shown in the figure, the main difference between the present embodiment and the previous embodiments is that the extension plate 112 may be folded into a bag structure.

Specifically, two sides of the gaps 113 may be in a triangle shape, the extension plate 112 is provided with a plurality of bending lines 114 at intervals along an extending direction of the extension plate 112, and two sides of the extension plate 112 are oppositely provided with a plurality of snap-cut lines 115. The plurality of bending lines 114 are configured to be overlapped and folded for the extension plate 112 corresponding to the gap 113, and the plurality of snap-cut lines 115 on the corresponding side are snapped with each other. Thus, the extension plate 112 may be folded into a bag structure. As a result, the extension plate 112 of the present embodiment may be folded into a bag structure for accommodating a sauce pack 95 such as ketchup, sweet and sour sauce, and the like. It should be noted that when the sauce pack is put in the bag structure formed by folding the extension plate 112, one corner of the sauce pack 95 may be inserted into the gap 113 to further stably accommodate the sauce pack 95.

The multi-functional catering container 1 of the present disclosure allows the user to hold the food in the first storage unit 12 and the second storage unit 13 attached altogether by using the container 91 as the hand-held support object after holding the container 91 with only one hand, thus achieving the convenience of use. This may prevent consumers from using plastic bags and the like for the convenience of carrying, resulting in the environmental impact of plastic bags being used in large quantities.

The above description is merely illustrative rather than restrictive. Any equivalent modifications or alterations without departing from the spirit and scope of the present disclosure are intended to be included in the following claims.

What is claimed is:

1. A multi-functional catering container, comprising:

a loading body being a plate structure, a placement hole being provided on the loading body, the placement hole being used for engaging with an upper portion of a beverage cup thereby keeping the beverage cup in the placement hole;

a first storage unit disposed to extend from one side of the loading body, a bottom of the first storage unit being provided with a first bottom plane, a top of the first storage unit being provided with a first opening, and the first storage unit being used to accommodate food; and a second storage unit disposed to extend from another side of the loading body and opposite to the first storage unit, a bottom of the second storage unit being provided with a second bottom plane, a top of the second storage unit being provided with a second opening, and the second storage unit being used to accommodate another food;

wherein the loading body, the first storage unit, and the second storage unit are formed by integrally bending and gluing a plate body; and wherein the plate body comprises a loading body section, a first unit section, and a second unit section; the loading body section has the placement hole, the first unit section and the second unit section are disposed on two opposite sides of the loading body section, and the first unit section comprises a sidewall section and a plurality of bottom plate sections extending from the sidewall section; after the sidewall section is bent and encircled, one end is fixed to another end thereof, and the plurality of bottom plate sections are interlaced to form the first bottom plane, further forming the first storage unit; the second unit section comprises a main area section and two flank sections, the main area section comprises a first main area, a bottom plane area, and a second main area connected in sequence, and the two flank sections oppositely extend from the first main area; after the main area section is bent and encircled, the bottom plane area forms the second bottom plane, and one end of each of the flank sections is fixed to the second main area, further forming the second storage unit.

2. The multi-functional catering container according to claim 1, wherein two sides of the second storage unit and the second bottom plane are respectively provided with a folding line.

3. The multi-functional catering container according to claim 1, wherein the first bottom plane is formed by a plurality of bottom plate sections that are interlaced and snapped.

4. The multi-functional catering container according to claim 1, wherein the loading body is disposed with an extension plate extending from an edge of the placement hole.

5. The multi-functional catering container according to claim 4, wherein the extension plate is provided with a gap.

6. The multi-functional catering container according to claim 5, wherein a direction in which the loading body is disposed with the extension plate extending from an edge of the placement hole is perpendicular to a direction in which the first storage unit and the second storage unit are oppositely disposed.

7. The multi-functional catering container according to claim 4, wherein a direction in which the loading body is disposed with the extension plate extending from an edge of the placement hole is perpendicular to a direction in which the first storage unit and the second storage unit are oppositely disposed.

8. The multi-functional catering container according to claim 1, wherein an edge of the placement hole is extendedly disposed with an extension plate, and the extension plate is provided with a gap.

9. The multi-functional catering container according to claim 1, wherein the bottom plane area and the two flank sections are respectively provided with a folding line.

* * * * *